US009777667B2

(12) United States Patent
Fukuda et al.

(10) Patent No.: US 9,777,667 B2
(45) Date of Patent: Oct. 3, 2017

(54) FUEL INJECTOR AND CONTROL METHOD FOR INTERNAL COMBUSTION ENGINE

(75) Inventors: Takao Fukuda, Mito (JP); Hideyuki Sakamoto, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 1346 days.

(21) Appl. No.: 13/700,009

(22) PCT Filed: May 26, 2011

(86) PCT No.: PCT/JP2011/062045

§ 371 (c)(1),
(2), (4) Date: Jan. 4, 2013

(87) PCT Pub. No.: WO2011/149002

PCT Pub. Date: Dec. 1, 2011

(65) Prior Publication Data

US 2013/0104856 A1 May 2, 2013

(30) Foreign Application Priority Data

May 27, 2010 (JP) ..... 2010-121626

(51) Int. Cl.

*F02D 41/32* (2006.01)
*F02D 41/20* (2006.01)
*F02D 41/38* (2006.01)

(52) U.S. Cl.

CPC ..... *F02D 41/32* (2013.01); *F02D 41/20* (2013.01); *F02D 41/38* (2013.01); *F02D 2041/201* (2013.01); *F02D 2041/2006* (2013.01)

(58) Field of Classification Search

CPC ..... F02D 2041/2006; F02D 2041/201; F02D 2041/2013; F02D 2041/2068

See application file for complete search history.

(56) References Cited

U.S. PATENT DOCUMENTS 4,327,693 A * 5/1982 Busser ..... F02D 41/20 123/490
4,604,675 A * 8/1986 Pflederer ..... F02D 41/20 123/490

(Continued)

FOREIGN PATENT DOCUMENTS

CN 1259190 A 7/2000
CN 1975141 A 6/2007

(Continued)

OTHER PUBLICATIONS

Chinese Office Action dated Dec. 9, 2014 (Six (6) pages).
Corresponding International Search Report with English Translation dated Jun. 21, 2011 ( three (3) pages).

*Primary Examiner* — Hieu T Vo
*Assistant Examiner* — Sherman Manley
(74) *Attorney, Agent, or Firm* — Crowell & Moring LLP

(57) ABSTRACT

A fuel injection control system for an internal combustion engine includes a plurality of first energy storage elements each for supplying a high voltage to a fuel injection solenoid valve, boosting circuits each for boosting a battery voltage and electrically charging one of the first energy storage elements, a second energy storage element for accumulating electrical energy of the battery voltage, and a switching circuit for transferring the electrical energy between the plurality of first energy storage elements via the second energy storage element. This configuration enables the fuel injection control system for an internal combustion engine to implement stabilized supply of a fuel by obtaining within a short time the high voltage needed to operate the fuel injector both accurately and reliably, and to contribute to cost reduction by, for example, alleviating capability requirements and part performance requirements of the individual boosting circuits.

7 Claims, 14 Drawing Sheets

(56) References Cited

U.S. PATENT DOCUMENTS

| | | | | |
|---|---|---|---|---|
| 5,532,526 | A * | 7/1996 | Ricco | F02D 41/20 123/490 |
| 6,212,053 | B1 | 4/2001 | Hoffmann et al. | |
| 6,407,593 | B1 * | 6/2002 | Kawamoto | F02D 41/20 327/110 |
| 6,564,771 | B2 * | 5/2003 | Rueger | F02D 41/20 123/299 |
| 7,474,035 | B2 * | 1/2009 | Fukagawa | F02D 41/2096 123/490 |
| 7,944,117 | B2 * | 5/2011 | Ripoll | F02D 41/2096 310/316.01 |
| 2008/0289608 | A1 * | 11/2008 | Matsuura | F02D 41/20 123/490 |
| 2008/0316670 | A1 * | 12/2008 | Matsuura | F02D 41/20 361/152 |

FOREIGN PATENT DOCUMENTS

| | | | |
|---|---|---|---|
| DE | 101 20 143 | A1 | 10/2002 |
| EP | 1 814 167 | A2 | 8/2007 |
| JP | 11-210530 | A | 8/1999 |
| JP | 2000-345898 | A | 12/2000 |
| JP | 2001-14045 | A | 1/2001 |
| JP | 2003-161193 | A | 6/2003 |
| JP | 2009-243418 | A | 10/2009 |

* cited by examiner

FUEL INJECTOR AND CONTROL METHOD FOR INTERNAL COMBUSTION ENGINE

TECHNICAL FIELD

The present invention relates generally to control systems and control methods for fuel injection into internal combustion engines. More particularly, the invention concerns a control system and control method for transferring electrical energy between a plurality of first energy storage elements each for supplying a high voltage to a fuel injector, via a second energy storage element using a battery voltage to accumulate the electrical energy.

BACKGROUND ART

In conventional control system for fuel injection into an internal combustion engine, when a solenoid valve of an injector is opened, a battery voltage VB is boosted with a boosting circuit and then a high voltage that has thus been generated by the boosting circuit is applied to the injector for accelerated response of the solenoid valve in the injector. In this conventional technique, a capacitor, for example, is used as an element for storage of the boosted electrical charge.

When the control system opens the solenoid valve of the injector, since the system consumes the charge energy and lowers the voltage, a recharge of the capacitor from the boosting circuit is started. During the recharge, if next injection timing precedes storage of a sufficient amount of charge energy for valve opening of the injector, the valve of the injector can by no means be opened or even if the valve can be opened, the injector may malfunction. These events have caused variations in fuel injection accuracy of the injector.

In order to solve this problem, providing a plurality of energy storage capacitors and boosting circuits and using both in alternate form, for example, is proposed as described in Patent Documents 1 and 2.

PRIOR ART LITERATURE

Patent Documents

Patent Document 1: JP-2003-161193-A
Patent Document 2: JP-2000-345898-A

SUMMARY OF THE INVENTION

Problem to be Solved by the Invention

In the above solution, however, it is necessary as prerequisites that one of the capacitor voltages should have reached a predefined voltage level by the time the injector is opened, and that the fact that the predefined voltage level has been reached should mean that charging of the capacitor has been completed, that is, that the boosting circuit corresponding to the capacitor be in an electrically deactivated condition. Accordingly, the boosting circuits have been required to have the part performance and heat-releasing performance matching their heaviest-loaded states, and that has caused an increase in costs.

In order to solve this problem, an object of the present invention is to improve usage efficiency of a plurality of boosting circuits, alleviate capability requirements and part performance requirements of the individual boosting circuits, disperse heat due to boosting, thereby reduce costs, and reliably supply a high voltage necessary for valve opening of an injector.

Means for Solving the Problem

In order to solve the foregoing problem, a fuel injection control system according to an aspect of the present invention is a control system used for a fuel injection device equipped with a fuel injection solenoid valve for supplying a fuel directly to a combustion chamber interior of an internal combustion engine, the system including a plurality of first energy storage elements each for supplying a high voltage to the fuel injection solenoid valve, a boosting circuit for boosting a battery voltage and electrically charging each of the first energy storage elements, a second energy storage element for accumulating electrical energy of the battery voltage, and a switching circuit for transferring the electrical energy between the plurality of first energy storage elements via the second energy storage element.

The present specification includes the contents of the specification and/or drawings accompanying the Japanese Patent Application, No. 2010-121626, from which the present application claims priority.

Effects of the Invention

In the above fuel injection control system according to the present invention, since electrical energy is transferred between the plurality of voltage-boosting energy storage elements, the desired high voltage necessary for the opening of the valve involved with the next fuel injection is obtained, so the fuel injector operates both accurately and reliably and implements stabilized supply of the fuel. This improves usage efficiency of a plurality of boosting circuits, alleviates capability requirements and part performance requirements of the individual boosting circuits, disperses heat due to boosting, and thereby contributes to cost reduction.

MODES FOR CARRYING OUT THE INVENTION

Figure 1:
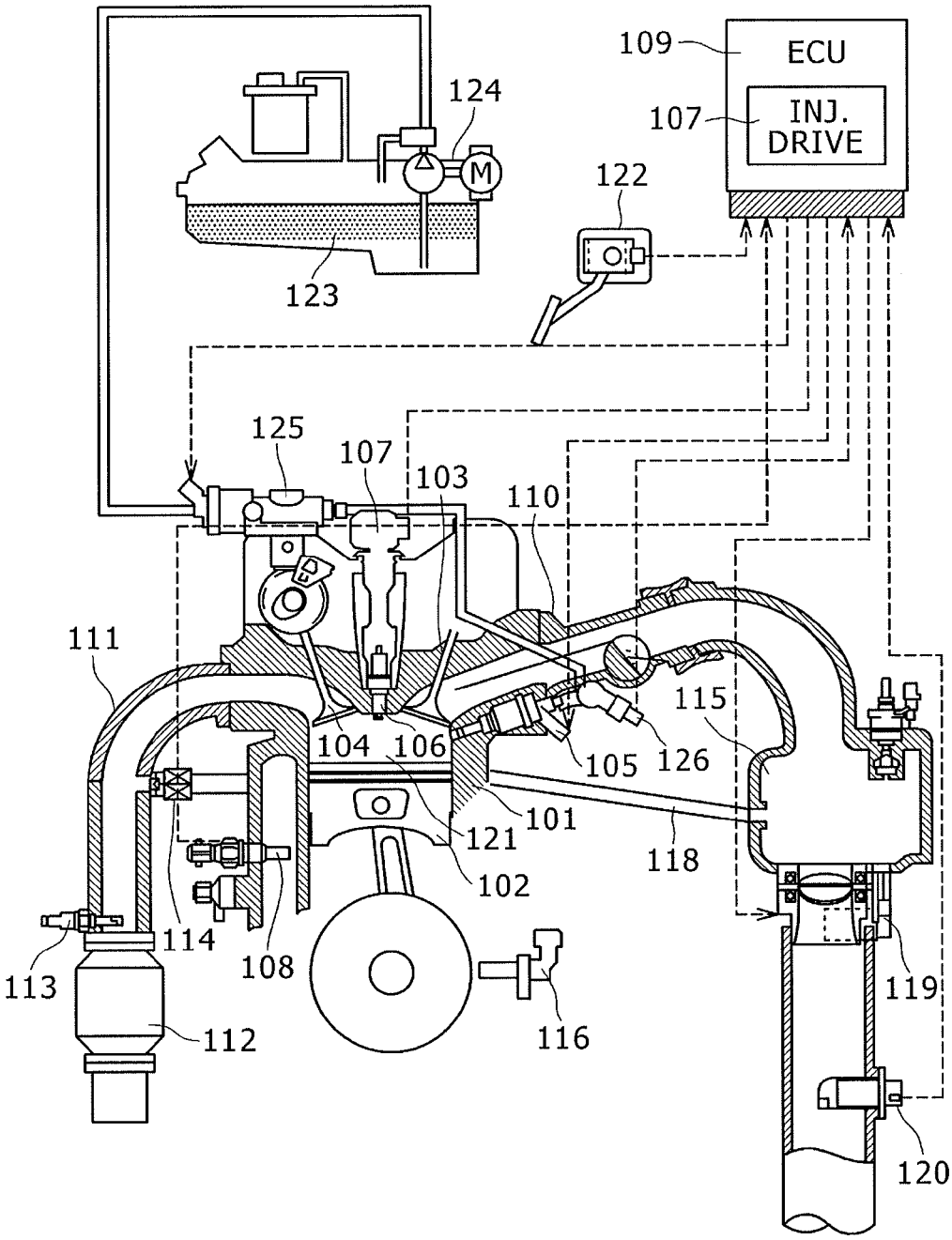
FIG. 1 is an outline diagram of a system for an internal combustion engine, showing the system as an embodiment of a fuel injection control system.

FIG. 1 is an outline diagram of a system for an internal combustion engine, showing the system as an embodiment of a fuel injection control system. The engine 101 includes a piston 102, an air intake valve 103, and an exhaust valve 104. After flow rate measurement by an air flowmeter (AFM) 120, air required for combustion in the engine 101 has the flow rate controlled by a throttle valve 119 and then the air is supplied to a combustion chamber 121 of the engine 101 via a collector 115, an air intake pipe 110, and the air intake valve 103.

Fuel is supplied from a fuel tank 123 to the internal combustion engine by a low-pressure fuel pump 124, and then a pressure of the fuel is boosted by a high-pressure fuel pump 125 accompanying the internal combustion engine, to a level at which the fuel can be injected even below a pressure of the combustion chamber 121 in a compression stroke.

The fuel that has thus been boosted to the high pressure is injected in finely atomized form from a fuel injector 105 into the combustion chamber 121 of the engine 101, and is ignited by an ignition plug 106 that receives energy from an ignition coil 107. After-combustion exhaust gases are discharged into an exhaust pipe 111 via the exhaust valve 104 and cleaned by a three-way catalyst 112.

A signal from a crank angle sensor 116 of the engine 101, an air volume signal from the AFM 120, a fuel pressure signal from a fuel pressure sensor 126, a signal from an oxygen sensor 113 for detecting an oxygen concentration in the exhaust gases, a signal from an engine coolant temperature sensor 108, and an accelerator angle signal from an accelerator angle sensor 122 are input to an engine control unit (ECU) 109 that contains the fuel injection control system 127.

The ECU 109 calculates an engine torque requirement from the signal received from the accelerator angle sensor 122, the ECU also performing functions such as discriminating an idling state. In addition, the ECU 109 includes a speed detection element that computes a rotating speed of the engine from the signal received from the crank angle sensor 116. Furthermore, the ECU 109 calculates the amount of intake air required for the engine 101, controls the throttle valve 119 to obtain an angle appropriate for the intake air volume, and further calculates the amount of fuel required.

During a predetermined time matching the calculated fuel quantity requirement and the pressure of the fuel, the fuel injection control system 127 outputs to the fuel injector 105 a current required for the injector to inject the fuel. The ECU 109 outputs to the ignition plug 106 an ignition signal that ignites the plug in optimal timing.

An exhaust gas recirculation (EGR) pathway 118 is connected between the exhaust pipe 111 and the collector 115. An EGR valve 114 is provided midway on the EGR pathway 118. The ECU 109 controls an opening angle of the EGR valve 114, and the gas emissions in the exhaust pipe 111 recirculate through the intake pipe 110 as necessary.

Figure 2:
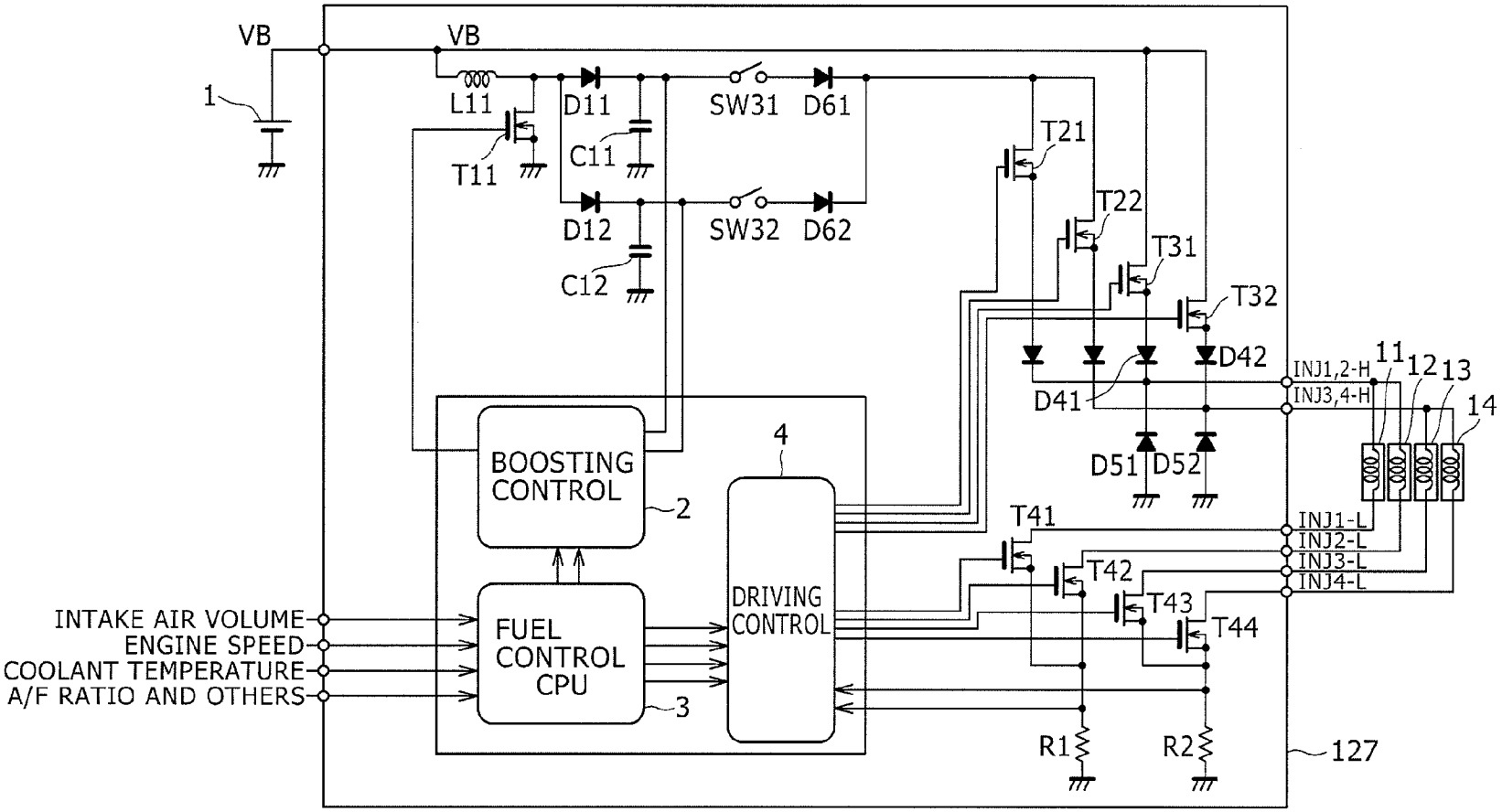
FIG. 2 is a circuit diagram of a fuel injection device according to a conventional technique.
Figure 3:
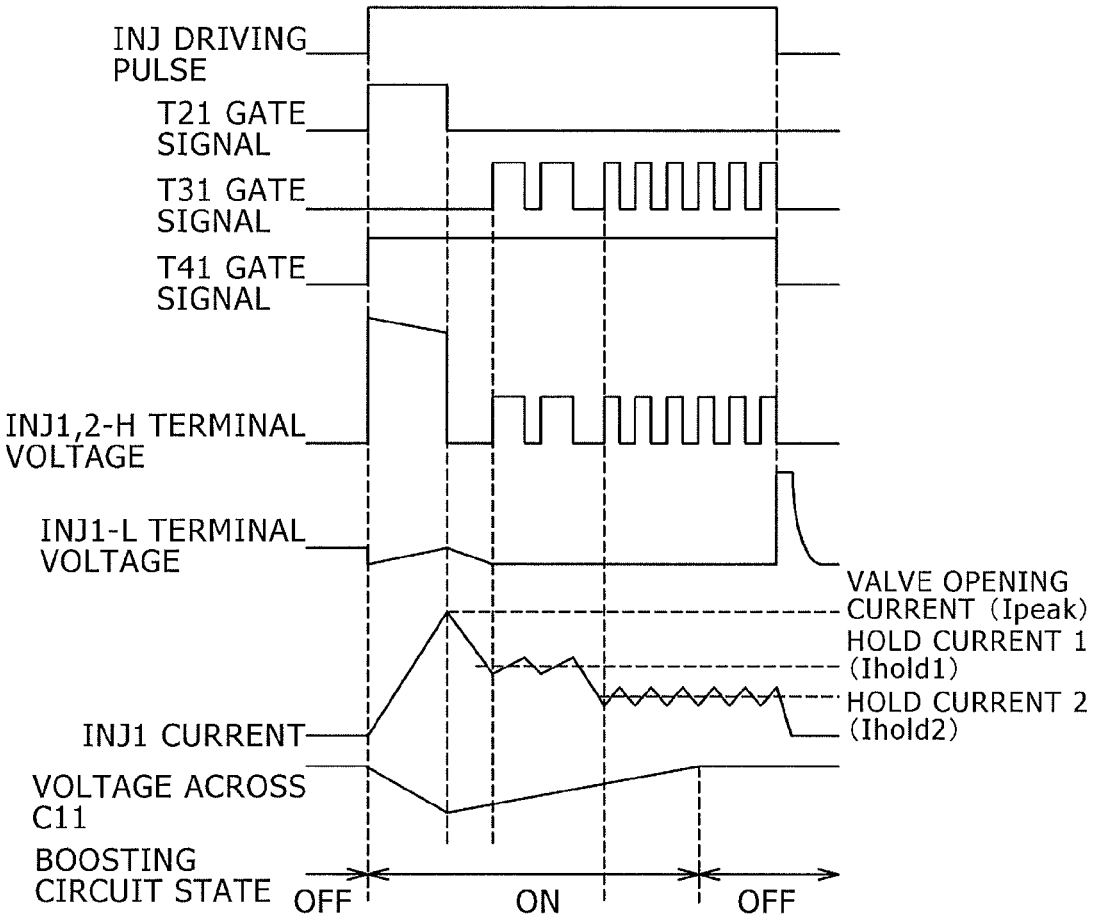
FIG. 3 is an operational timing chart of the fuel injection device according to the conventional technique.
Figure 4:
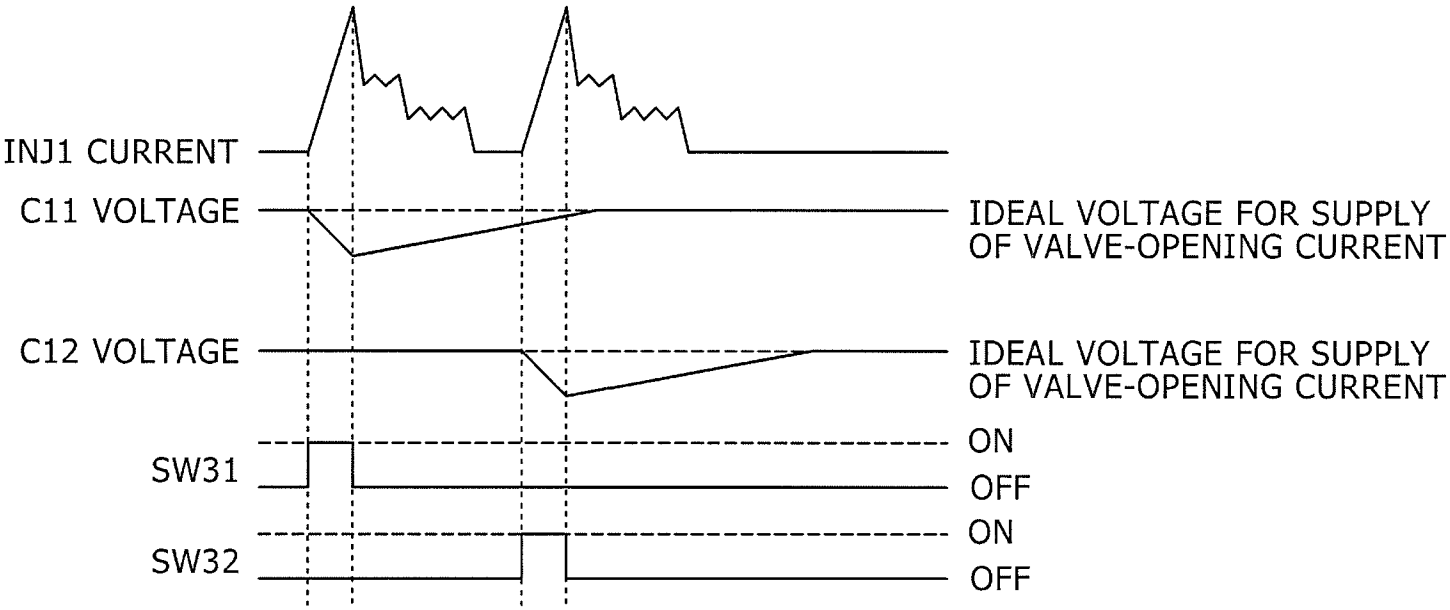
FIG. 4 is another operational timing chart of the fuel injection device according to the conventional technique, showing the operational timing applying when a fuel injection time interval is short.

FIG. 2 shows a circuit composition of a fuel injection device according to a conventional technique, and FIGS. 3 and 4 show operational timing charts of an injector used in the conventional technique.

Referring to FIG. 2, a boosting circuit including a battery 1, a boosting coil L11, a boost-switching element T11, and rectifier diodes D11 and D12, boosts the battery voltage VB via the boosting coil L11 by a switching action of the boost-switching element T11, and thereby charges boosting capacitors C11 and C12.

For enhanced responsiveness of a desired injector, when a valve thereof is opened, FETs (T21) and (T22) are turned on to supply a high voltage to the injector and then FETs (T31) and (T32) are switched to control a current of the injector to a constant level, thus retaining the open state of the valve. Of a plurality of injectors, one injector to which power is to be supplied is selected by on/off operations on FETs (T41), (T42), (T43), and (T44).

How the fuel injection device according to the conventional technique operates to drive an injector 11 of the plurality of injectors is described below using FIG. 3.

When, in response to an injector driving pulse that has been output from a fuel control CPU, gate signals are applied to the FETs (T21) and (T41) in order to supply a valve-opening current Ipeak for a predetermined time, a boosted voltage is applied across the injector 11 and the FET (T21) continues to hold its 'on' state until the supply of the previously set valve-opening current has been started. Once an arrival of the supply current at the valve-opening current level has been detected from a voltage level across a current detection resistor R1, the FET (T31) is switched to control the current of the injector 11 to a previously set level of a hold current 1 (ihold 1) or a hold current 2 (ihold 2) and maintain this current level.

Since the application of the high voltage to the injector lowers the voltage of the boosting capacitor C11, the boosting circuit including the boosting coil L11, the boost-switching element T11, and the rectifier diode D11, boosts the voltage of the boosting capacitor C11 to a predetermined voltage level.

FIG. 4 is a timing chart that applies when a fuel injection time interval in the fuel injection device according to the conventional technique is short. This timing chart indicates that first injection uses the energy stored in the boosting capacitor C11 by activation of a switch SW31, and that second injection uses the energy stored in the boosting capacitor C12 by activation of a switch SW32.

One problem associated with the conventional technique has been that as discussed earlier herein, the charging of either capacitor needs to have been completed by the time the injector injects the fuel.

Next, embodiments of a fuel injection control system according to the present invention will be described.

(First Embodiment)

Figure 5:
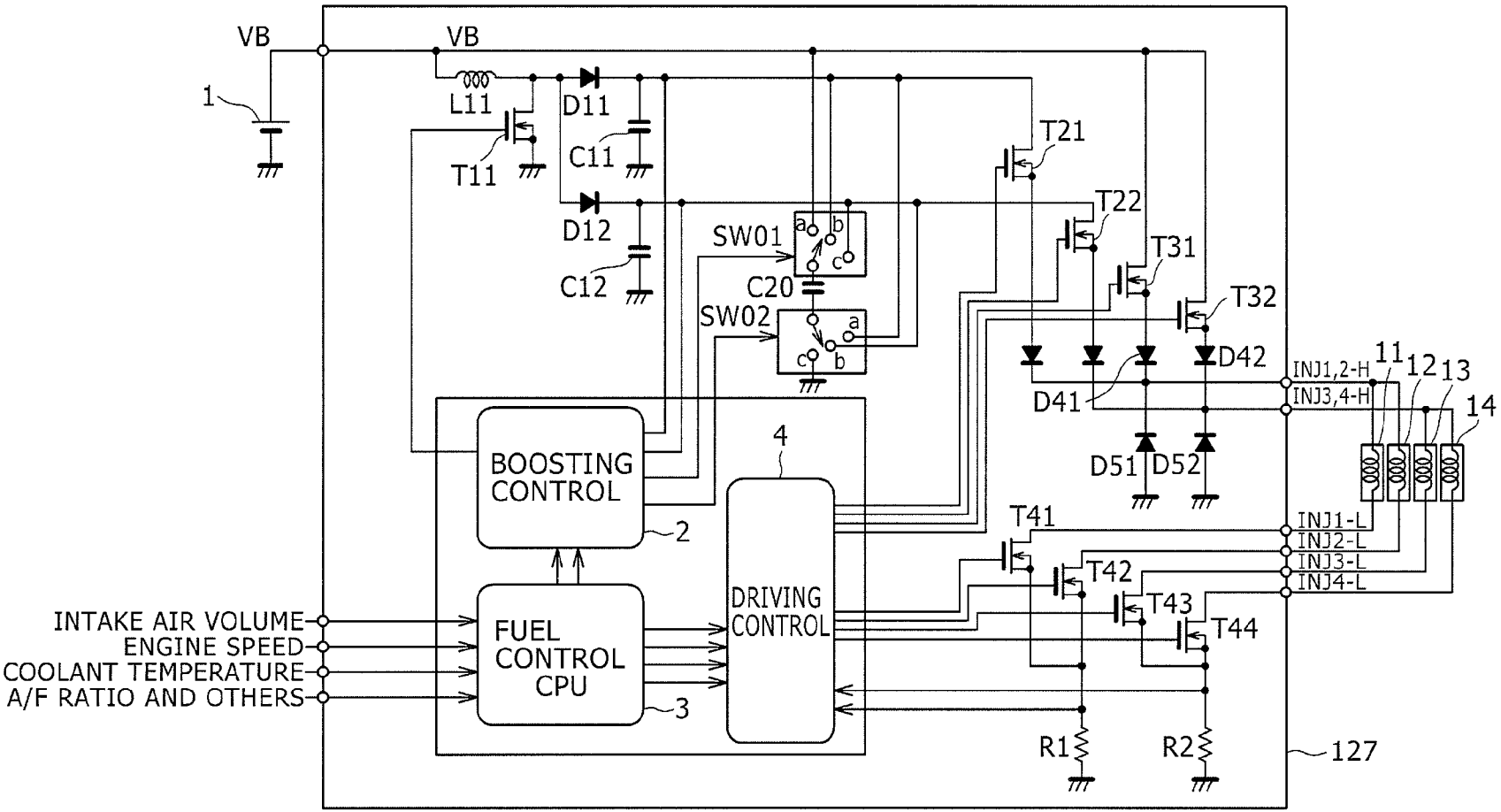
FIG. 5 is a circuit diagram showing a first embodiment of a fuel injection control system according to the present invention.

FIG. 5 is a circuit diagram showing a first embodiment of a fuel injection control system according to the present invention:

As shown in FIG. 5, a boosting circuit of the first embodiment includes a battery 1, a boosting coil L11, a boost-switching element T11, and diodes D11 and D12. This circuit is composed so that upon switching operation of the boost-switching element T11, the battery voltage VB is boosted via the boosting coil L11 and then rectified by the diodes D11, D12, thereby to charge capacitors C11 and C12.

The circuit of the first embodiment additionally includes a capacitor C20 for energy transfer. This circuit is composed so that one electrode of the energy transfer capacitor C20 can be connected to a contact point "a" of a switching circuit SW01 that corresponds to a potential of the battery voltage VB, a contact point "b" of the switching circuit SW01 that corresponds to a potential of a charging side for the boosting capacitor C11, or a contact point "c" of the switching circuit SW01 that corresponds to a potential of a charging side for the capacitor C12. The circuit is also composed so that the other electrode of the energy transfer capacitor C20 can be connected to a contact point "a" of a switching circuit SW02 that corresponds to a potential of the charging side for the boosting capacitor C11, a contact point "b" of the switching circuit SW02 that corresponds to a potential of a charging side for the boosting capacitor C12, or a contact point "c" of the switching circuit SW02 that is connected to a grounding terminal GND.

Figure 6:
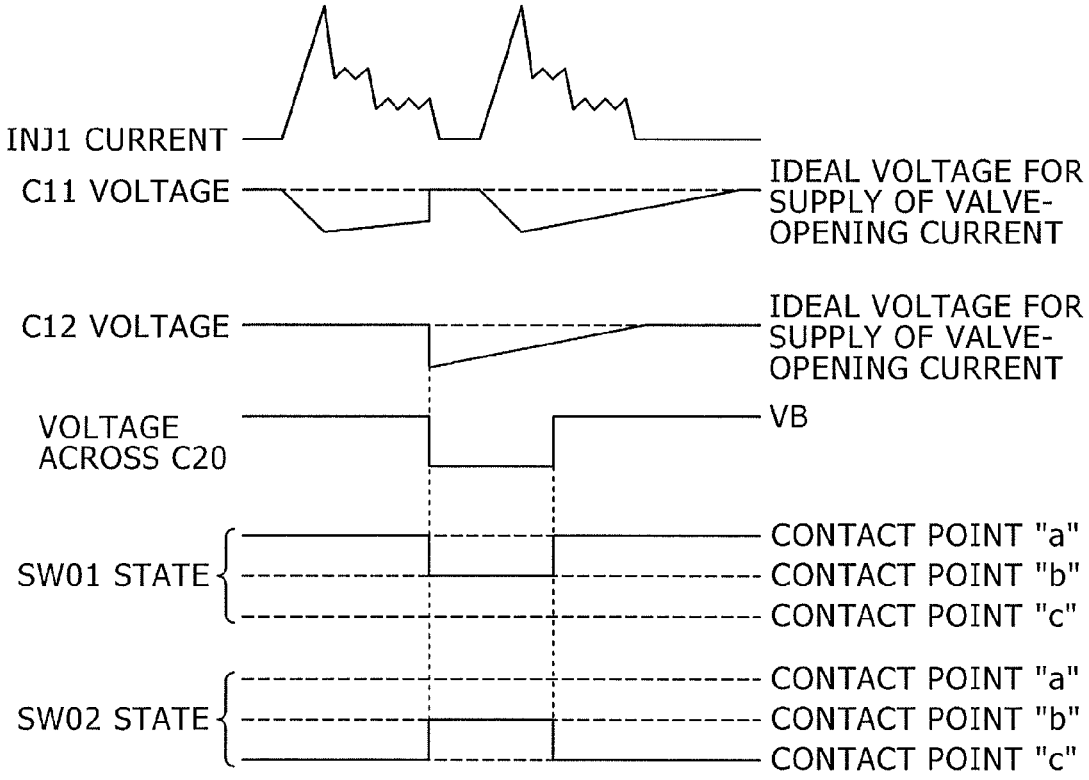
FIG. 6 is an operational timing chart relating to continuously supplying a current to an injector 11 in the first embodiment.

FIG. 6 is an operational timing chart relating to continuously supplying a current to an injector 11 in the first embodiment.

As the current is supplied to the injector 11, the voltage of the boosting capacitor C11 decreases, which in turn activates the boosting circuit. At this time, if next injection occurs before the voltage of the boosting capacitor C11 returns to an ideal voltage level required for valve-opening current supply, part of the energy stored within the boosting capacitor C12 is transferred to the boosting capacitor C11 via the energy transfer capacitor C20.

More specifically, the two switching circuits, SW01 and SW02, arranged across the energy transfer capacitor C20, are set to the respective contact points "a" and "c" beforehand. In addition, the energy transfer capacitor C20 is charged with the battery voltage VB beforehand. When the energy in the boosting capacitor C12 is to be transferred to the boosting'capacitor C11, the switching circuit SW01 is set to its contact point "b" and the switching circuit SW01 to its contact point "b" as well. The energy is then transferred instantaneously. The amount of energy transferred is determined by a capacitance and charge quantity of the three capacitors, C11, C12, C20.

One of crucial features of the present invention is described below. For example, when the voltage of the boosting capacitor C12 is being boosted, even before the ideal voltage required for valve-opening current supply is reached, if the voltage of the boosting capacitor C11 is lower than a sum of the voltages of the energy transfer capacitor C20 and the boosting capacitor C12, that is, until the voltage of the boosting capacitor C12 has decreased to a level equivalent to the voltage of the boosting capacitor C11 minus the battery voltage VB, energy can be transferred from the boosting capacitor C11 to the boosting capacitor C12 by on/off operations on the switching circuits SW01 and SW02, and the transfer is instantaneous. Control for boosting to a desired voltage level can therefore be implemented by repeating the above sequence.

In addition, the transfer of the energy is not limited to the above conditions. For energy transfer from the boosting capacitor C11 to the boosting capacitor C12, first after the switching circuits SW01 and SW02 have been set to the respective contact points "a" and "c" to charge the energy transfer capacitor C20 with the battery voltage VB, the energy transfer from the capacitor C11 to the capacitor C12 can be realized by changing the settings of the switching circuits SW01, SW02 to the contact points "c," "a," respectively.

(Second Embodiment)

Figure 7:
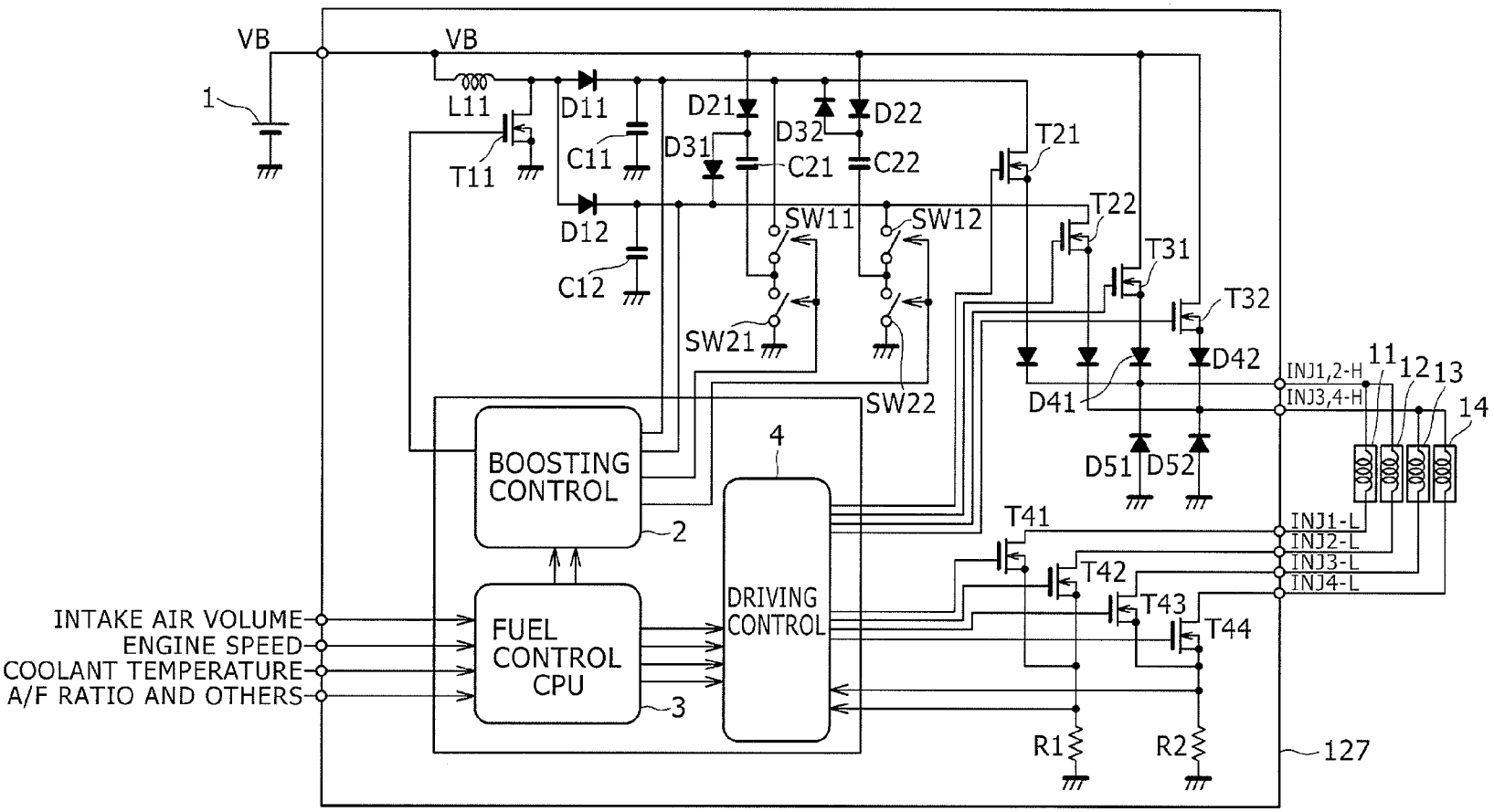
FIG. 7 is a circuit diagram showing a second embodiment of a fuel injection control system according to the present invention.

FIG. 7 is a circuit diagram showing a second embodiment of a fuel injection control system according to the present invention. In the circuit of the second embodiment, the energy transfer capacitor C20 in the first embodiment of FIG. 5 is divided into two capacitors, C21 and C22, and similarly the two switching circuits, SW01 and SW02, are replaced by diodes D21, D22, D31, D32 and switching circuits SW11, SW21, SW12, SW22, respectively.

In this circuit, when energy is to be transferred from the boosting capacitor C11 to the boosting capacitor C12, first the switching circuit SW21 is activated to conduct the battery voltage VB into the energy transfer capacitor C21 via the diode D21, thereby charging the capacitor C21. Next, activating the switching circuit SW11 by deactivating the switching circuit SW21 conducts the voltage of the boosting capacitor C11 into the energy transfer capacitor C21, thereby charging the capacitor C21. The voltage increment that has thus been obtained in the boosting capacitor C11 elevates the voltage of the boosting capacitor C12 via the diode D31.

Conversely, when energy is to be transferred from the boosting capacitor C12 to the boosting capacitor C11, first the switching circuit SW22 is activated to conduct the battery voltage VB into the energy transfer capacitor C22 via the diode D22, thereby charging the capacitor C22. Next, activating the switching circuit SW12 by deactivating the switching circuit SW22 conducts the voltage of the boosting capacitor C12 into the energy transfer capacitor C22, thereby charging the capacitor C22. The voltage increment that has thus been obtained in the boosting capacitor C12 elevates the voltage of the boosting capacitor C11 via the diode D32.

In the second embodiment, since the transfer of energy between the two boosting capacitors, C11 and C12, instantly occurs in the above fashion, control for boosting to a desired voltage level can be implemented by repeating the above sequence.

(Third Embodiment)

Figure 8:
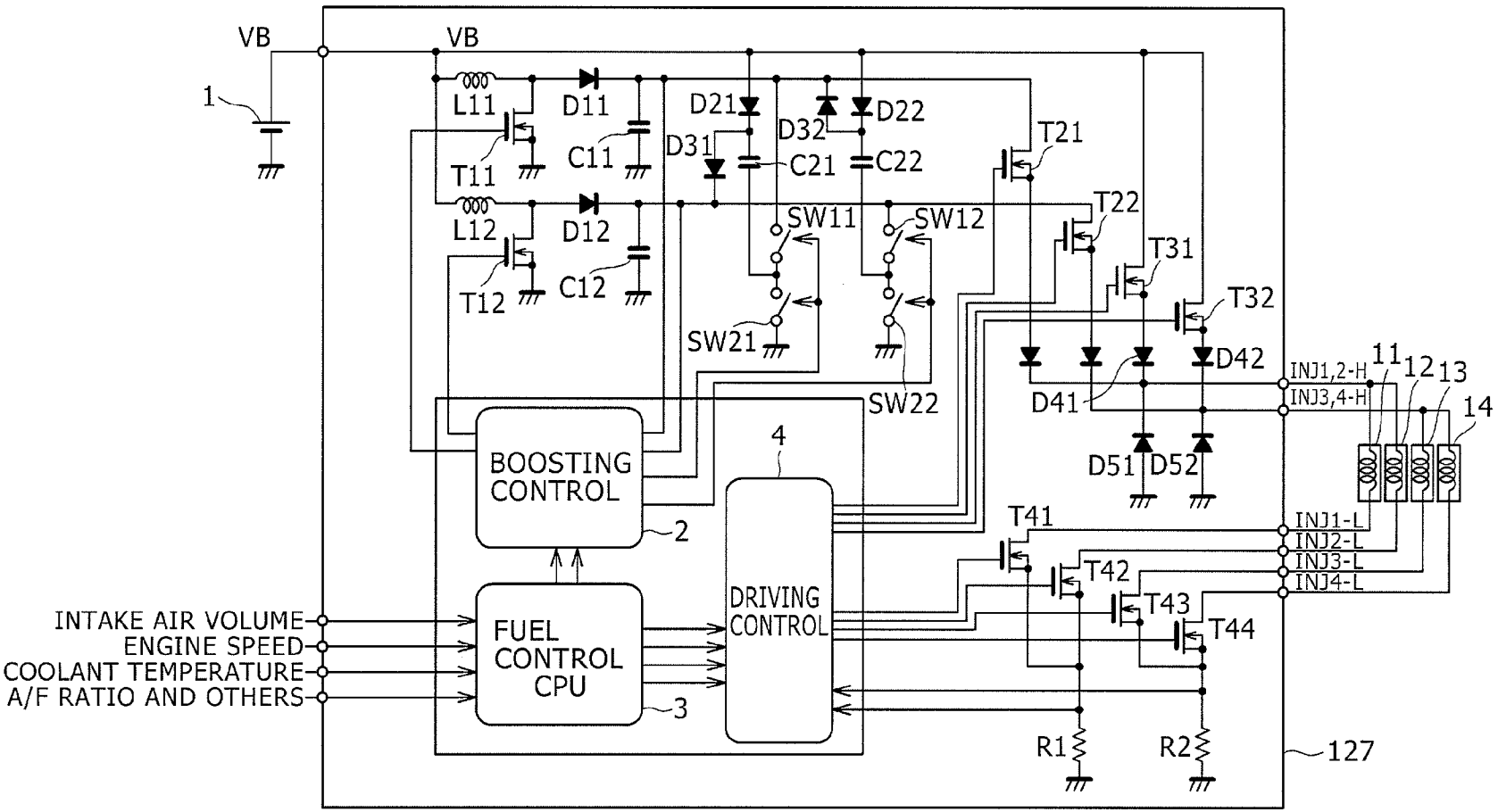
FIG. 8 is a circuit diagram showing a third embodiment of a fuel injection control system according to the present invention.

FIG. 8 is a circuit diagram showing a third embodiment of a fuel injection control system according to the present invention. The third embodiment uses an independent boosting circuit for each of the boosting capacitors C11 and C12.

For example, if the conventional fuel injection control system shown in FIG. 2 includes an independent boosting circuit for each of the boosting capacitors C11 and C12, when the charging of one capacitor is completed, the boosting circuit corresponding to the capacitor will also halt. In the third embodiment of the present invention, however, energy transfer between the boosting capacitors C11 and C12 enables simultaneous operation of both boosting circuits, thus improving usage efficiency of the boosting circuits.

(Fourth Embodiment)

Figure 9:
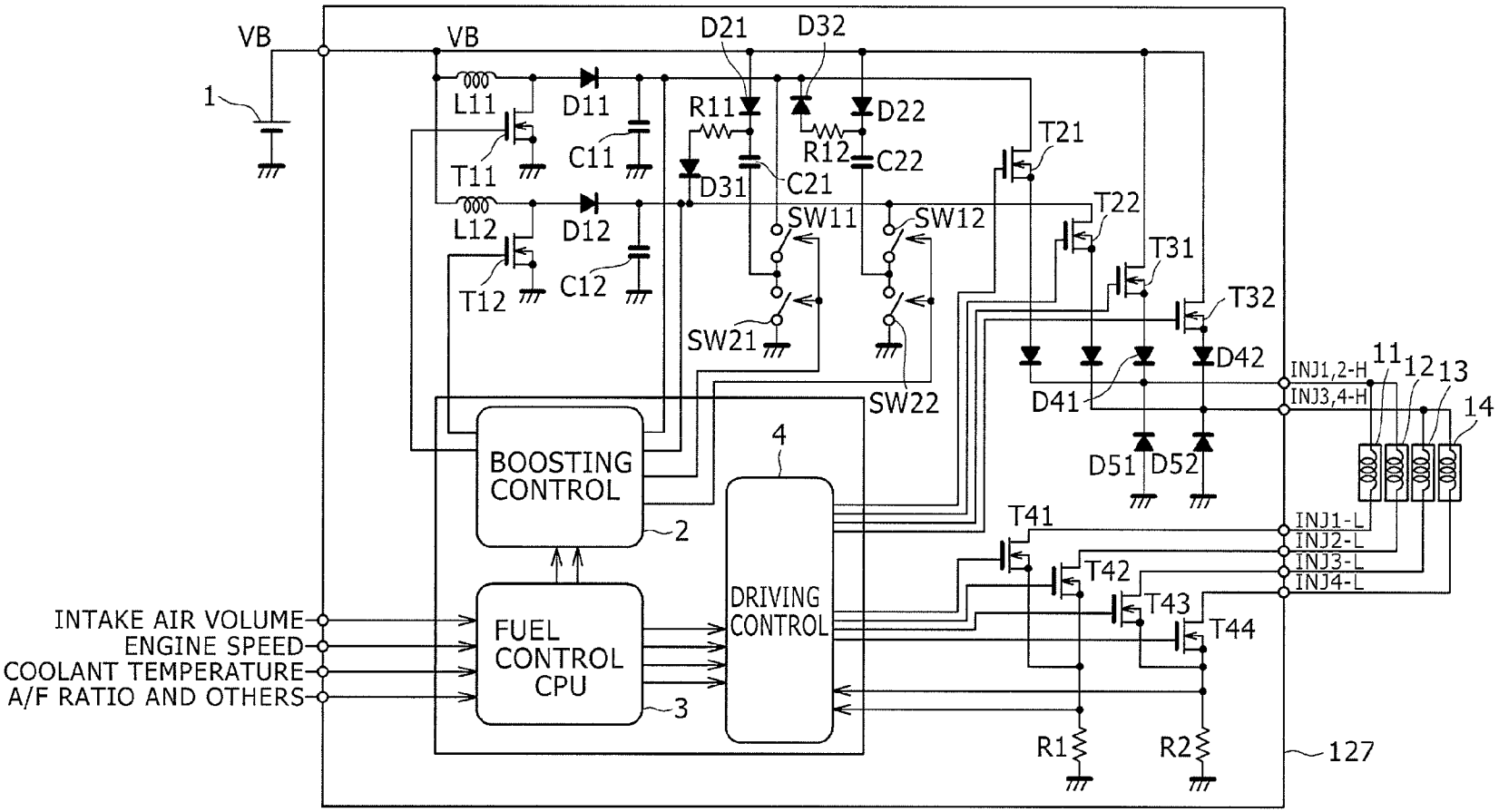
FIG. 9 is a circuit diagram showing a fourth embodiment of a fuel injection control system according to the present invention.

FIG. 9 is a circuit diagram showing a fourth embodiment of a fuel injection control system according to the present invention. In the fourth embodiment, when electrical energy is transferred between the boosting capacitors C11 and C12 via the energy transfer capacitor C21 or C22, the energy is passed through a resistor R11 or R12 to ensure that the transfer of the energy occurs over a fixed period of time, not instantaneously, that is denoted by a time constant determined by magnitude of a resistance value of the resistor and the capacity (capacities) of the capacitor(s). The fourth embodiment enables the energy transfer between the boosting capacitors to be controlled according to particular activation timing of switching means SW01 and SW02.

In addition, means for monitoring a voltage of the boosting capacitors C11 and C12 may be provided (the monitoring means is not shown), such that a switching state of the switching means SW01 and SW02 can be varied when the capacitors reach a desired voltage.

Figure 10:
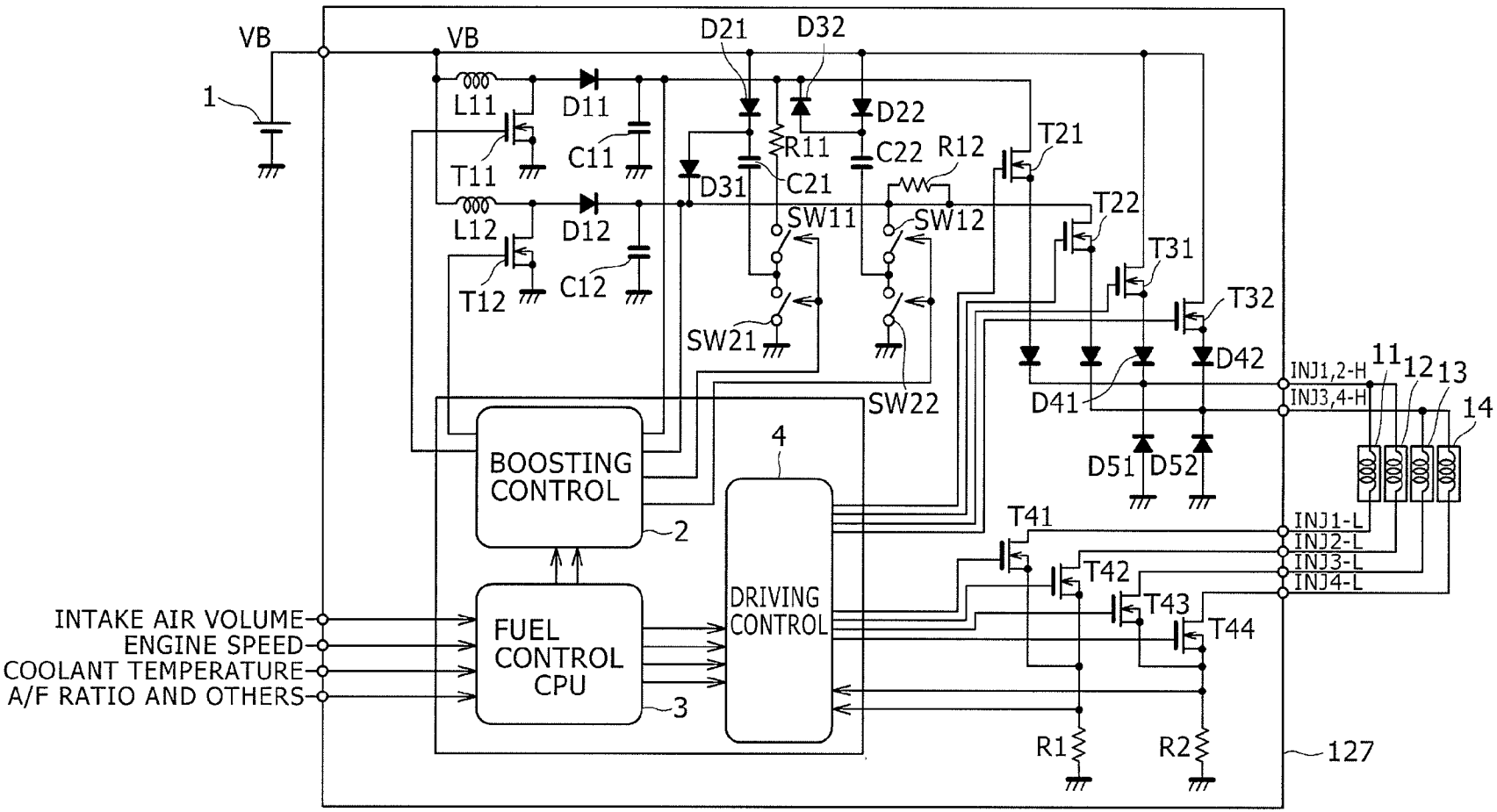
FIG. 10 is a circuit diagram showing a modification of the fourth embodiment.

FIG. 10 is a circuit diagram showing a modification of the fourth embodiment of the present invention. In this modification, as in the fourth embodiment, when electrical energy is transferred between the boosting capacitors C11 and C12 via the energy transfer capacitor C21 or C22, although the energy is passed through the resistor R11 or R12, the resistor is provided at a position different from that shown in FIG. 9.

Figure 11:
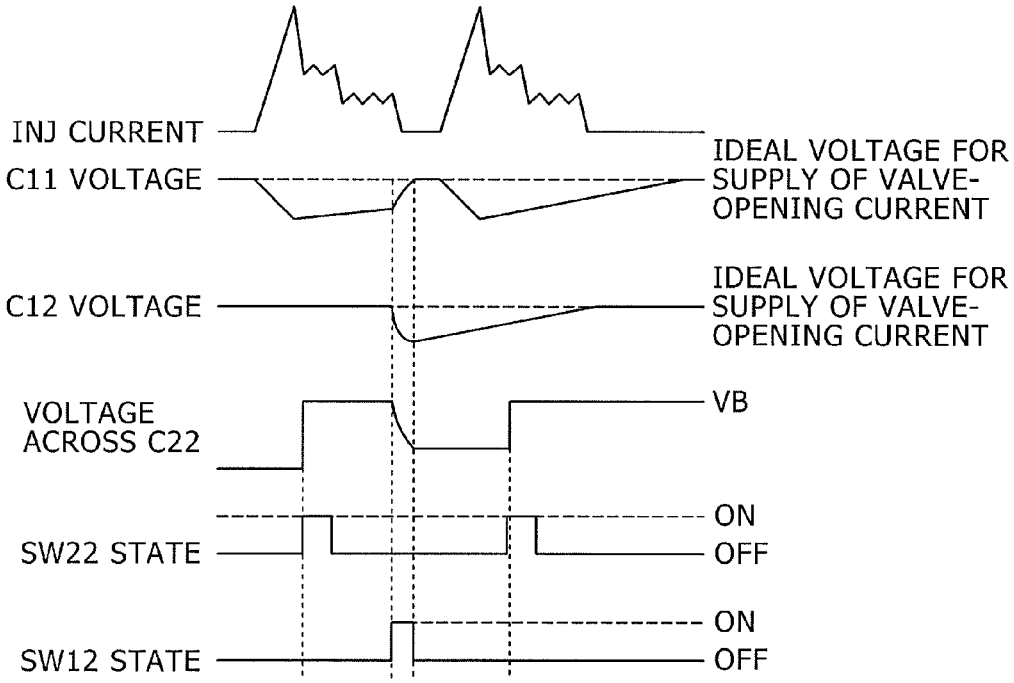
FIG. 11 is an operational timing chart of the fourth embodiment (including the modification).

FIG. 11 is an operational timing chart of the fourth embodiment (including the modification) shown in FIGS. 9 and 10. This timing chart applies to a case in which, when current is supplied to the injector 11, a voltage of the boosting capacitor C11 decreases and the transfer of electrical energy from the boosting capacitor C12 to the boosting capacitor C11 via the energy transfer capacitor C22 occurs for the next injection.

First the switching circuit SW22 is activated to charge the energy transfer capacitor C22 with the battery voltage VB, and then the switching circuit SW22 is deactivated to activate the switching circuit SW12. This transfers electrical energy to the boosting capacitor C11. The transfer of the energy, however, requires a fixed time, since the resistor R12 is present, as shown in FIG. 9, on a discharging route of the energy transfer capacitor C22, or as shown in FIG. 10, on a charging route of the energy transfer capacitor C22. Monitoring the voltage of the boosting capacitors C11 and C12 allows the switching circuit SW12 to be deactivated upon the desired voltage level being reached.

Furthermore, in the present invention, since the energy in one boosting capacitor can be arbitrarily transferred, the energy in the entire boosting circuit block can be maintained at a higher level than in the conventional scheme, by further raising the boosted voltage within the boosting capacitor to a level above the ideal valve-opening current supply voltage level desired for valve opening of the injector. The arbitrary transfer of the energy also enables response to a request for transient multistep fuel injection by, prior to fuel injection, temporarily transferring the energy within the boosting capacitor to be used for the injection, to the other boosting capacitor, then appropriately adjusting the ideal valve-opening current supply voltage level, and returning the energy after the injection from the injector.

Figure 12:
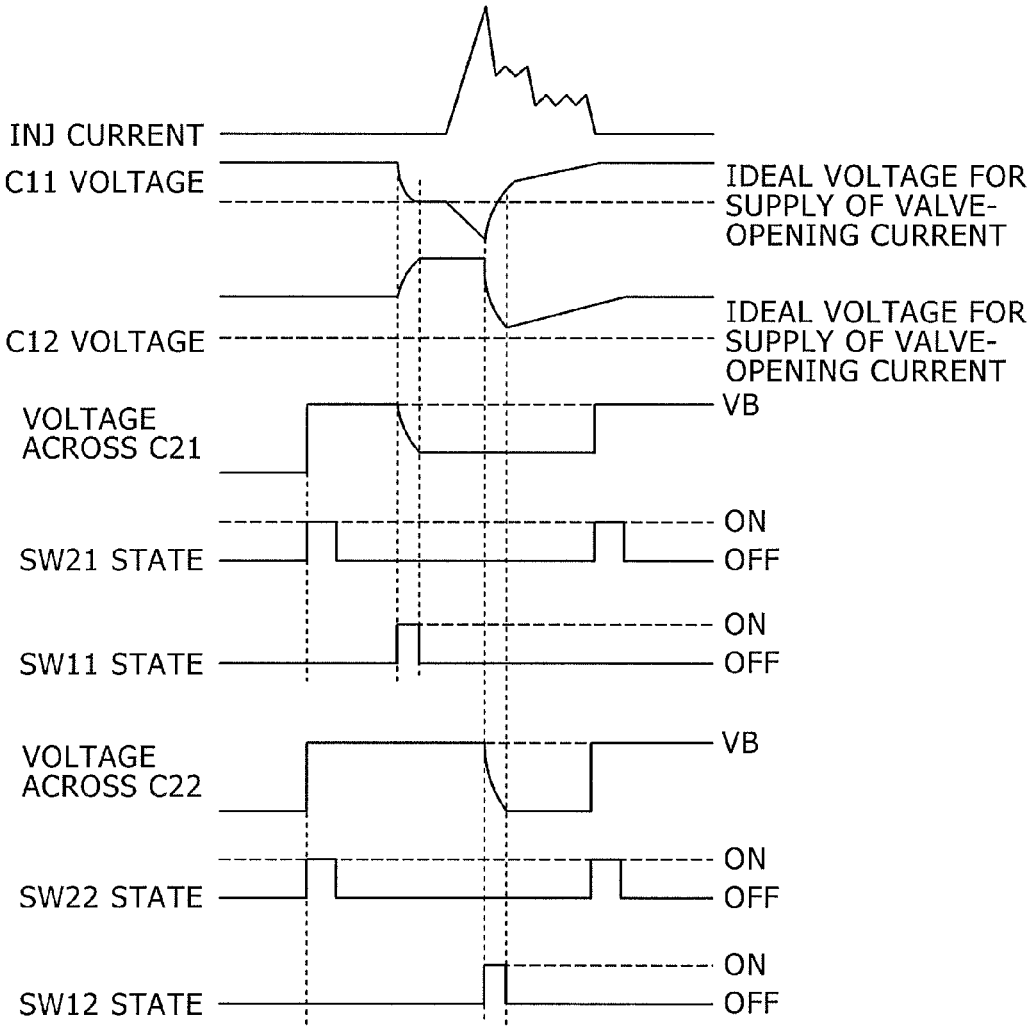
FIG. 12 is a timing chart applying to temporarily stowing energy of a boosting capacitor away into another capacitor.

FIG. 12 is a timing chart applying to temporarily stowing the energy of the boosting capacitor away into the other capacitor. The voltage of the boosting capacitors C11 and C12 is boosted to a level above the ideal valve-opening current supply voltage level, and before injection from the injector 11 is started, the voltage of the boosting capacitor C11 is adjusted by activation time control of the switching circuit SW11. The electrical energy is then transferred to the boosting capacitor C12 via the energy transfer capacitor C21. This energy transfer controls the voltage to the ideal valve-opening current supply voltage level. After the injection from the injector 11, the energy is transferred from the boosting capacitor C12 to the boosting capacitor C11 via the energy transfer capacitor C22. This energy transfer maintains the voltage of the boosting capacitor C11 at a level above the ideal valve-opening current supply voltage level, more rapidly than in the conventional circuit composition.

(Fifth Embodiment)

Figure 13:
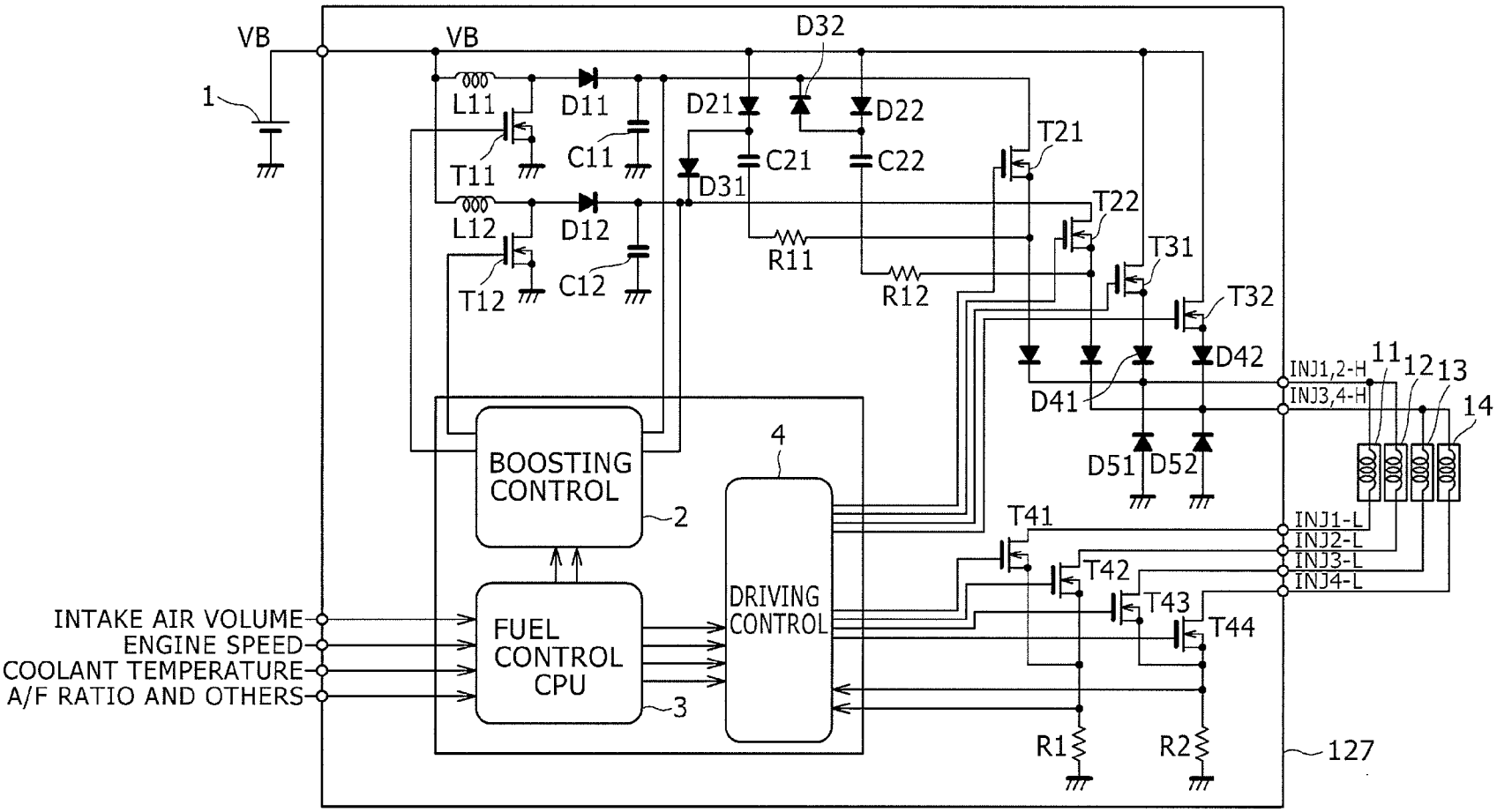
FIG. 13 is a circuit diagram showing a fifth embodiment of a fuel injection control system according to the present invention.

FIG. 13 is a circuit diagram showing a fifth embodiment of a fuel injection control system according to the present invention. This embodiment features using injector-driving circuit switching to realize switching for energy transfer.

(Sixth Embodiment)

Figure 14:
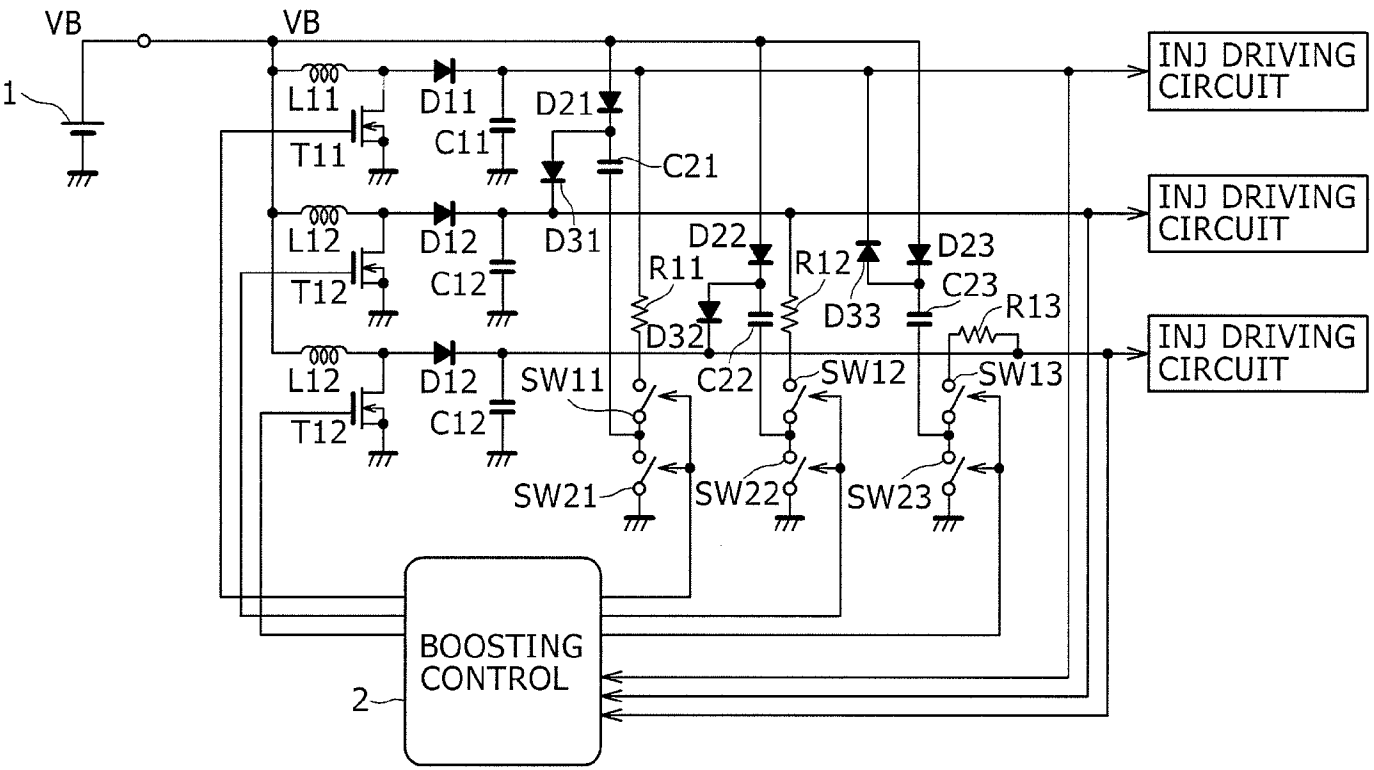
FIG. 14 is a circuit diagram showing a sixth embodiment of a fuel injection control system according to the present invention.

FIG. 14 is a circuit diagram showing a sixth embodiment of a fuel injection control system according to the present invention. Three boosting circuits are present in the sixth embodiment.

While capacitors have been used as an energy storage/accumulation element in each of the above embodiments, the kind of energy storage/accumulation element is not limited to capacitors and may be replaced by, for example, secondary cells (storage batteries/cells).

The contents of all the publications, patent documents, and patent applications that have been herein cited are incorporated herein by reference in their entirety.

DESCRIPTION OF REFERENCE NUMBERS AND SYMBOLS

1 . . . Battery
2 . . . Boosting circuit control block
3 . . . Fuel injection control computing means
4 . . . Fuel injector driving circuit control block
11-14 . . . Injector coils for fuel injectors
101 . . . Engine
102 . . . Piston
103 . . . Air intake valve
104 . . . Exhaust valve
105 . . . Fuel injector
106 . . . Ignition plug
107 . . . Ignition coil
108 . . . Coolant temperature sensor
109 . . . ECU (Engine Control Unit)
110 . . . Air intake pipe
111 . . . Exhaust pipe
112 . . . Three-way catalyst
113 . . . Oxygen sensor
114 . . . EGR valve
115 . . . Collector
116 . . . Crank angle sensor
118 . . . EGR passageway
119 . . . Throttle valve
120 . . . AFM
121 . . . Combustion chamber
122 . . . Accelerator angle sensor
123 . . . Fuel tank
124 . . . Low-pressure fuel pump
125 . . . High-pressure fuel pump
126 . . . Fuel pressure sensor
127 . . . Fuel injection control system
C11-C13 . . . Boosting capacitors
C20-C23 . . . Energy transfer capacitors
D11-D13 . . . Boosting diodes
D21-D23, D31-D33, D41, D42, D51, D52, D61, D62 . . . Diodes
L11-L13 . . . Boosting coils
T11-T13 . . . Boost-switching elements
T21-T22, T31, T33, T41-T44 FETs
R1, r2 . . . Current detection resistors
SW01, SW02, SW11-SW13, SW21-SW23, SW31, SW32 . . . Switching circuits

The invention claimed is:

1. A control system used for a fuel injection device equipped with a fuel injection solenoid valve for supplying a fuel directly to a combustion chamber interior of an internal combustion engine, the system comprising:

a plurality of first energy storage elements, each for supplying a high voltage to the fuel injection solenoid valve;

a boosting circuit for boosting a battery voltage and electrically charging each of the first energy storage elements;

a second energy storage element for accumulating electrical energy of the battery voltage; and a switching circuit for transferring the electrical energy between the plurality of first energy storage elements via the second energy storage element.

2. The fuel injection control system according to claim 1, wherein the system transfers the electrical energy between the plurality of first energy storage elements by operating the switching circuit and changing a connection potential across the second energy storage element as appropriate.

3. The fuel injection control system according to claim 1, further comprising a resistive element connected in series to the second energy storage element;

wherein the system controls an amount of the electrical energy transfer between the plurality of first energy storage elements by controlling an operation time of the switching circuit.

4. The fuel injection control system according to claim 3, wherein: prior to boosting, the system changes an operational state of the switching circuit.

5. The fuel injection control system according to claim 3, wherein:

the resistive element is connected in series to the second energy storage element, only when a charge is released from the second energy storage element.

6. The fuel injection control system according to claim 1, wherein the boosting circuit is present in plurality.

7. The fuel injection control system according to claim 2, wherein one end of the second energy storage element is connected, via the switching circuit, to a downstream side of the switching circuit for supplying the high voltage from one of the first energy storage elements to the fuel injection solenoid valve.

* * * * *